US007082766B1

(12) United States Patent
Widener et al.

(10) Patent No.: US 7,082,766 B1
(45) Date of Patent: Aug. 1, 2006

(54) ONE-PIECE CAN COMBUSTOR

(75) Inventors: Stanley Kevin Widener, Greenville, SC (US); Kevin Weston McMahan, Greer, SC (US); Thomas Edward Johnson, Greer, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/906,688

(22) Filed: Mar. 2, 2005

(51) Int. Cl.
*F02C 1/00* (2006.01)
*F02G 3/00* (2006.01)

(52) U.S. Cl. ..... 60/752; 60/770; 60/754

(58) Field of Classification Search ..... 60/752–760, 60/770
See application file for complete search history.

(56) References Cited

U.S. PATENT DOCUMENTS

| | | | | |
|---|---|---|---|---|
| 4,297,842 | A * | 11/1981 | Gerhold et al. | 60/776 |
| 6,098,397 | A * | 8/2000 | Glezer et al. | 60/772 |
| 6,105,372 | A * | 8/2000 | Mandai et al. | 60/755 |
| 6,134,877 | A * | 10/2000 | Alkabie | 60/800 |
| 6,543,233 | B1 * | 4/2003 | Young et al. | 60/752 |
| 6,606,861 | B1 * | 8/2003 | Snyder | 60/752 |
| 6,655,149 | B1 * | 12/2003 | Farmer et al. | 60/754 |
| 6,735,950 | B1 * | 5/2004 | Howell et al. | 60/748 |
| 6,751,961 | B1 * | 6/2004 | Pacheco-Tougas et al. | 60/752 |
| 6,810,673 | B1 * | 11/2004 | Snyder | 60/752 |
| 6,895,761 | B1 * | 5/2005 | Mitchell et al. | 60/796 |
| 6,938,424 | B1 * | 9/2005 | Tiemann | 60/752 |
| 2002/0152740 | A1 * | 10/2002 | Suenaga et al. | 60/39.23 |

* cited by examiner

*Primary Examiner*—William Rodriguez
(74) *Attorney, Agent, or Firm*—Cantor Colburn LLP

(57) ABSTRACT

A can combustor for an industrial turbine includes a transition piece transitioning directly from a combustor head-end to a turbine inlet using a single piece transition piece. In an exemplary embodiment, the transition piece is jointless.

19 Claims, 3 Drawing Sheets

ONE-PIECE CAN COMBUSTOR

BACKGROUND OF THE INVENTION

This invention relates generally to turbine components and more particularly to a combustion chamber.

Industrial gas turbine combustors are typically designed as a plurality of discrete combustion chambers or "cans" in an array around the circumference of the turbine. Conventionally, the walls of an industrial gas turbine can combustion chamber are formed from two major pieces: a cylindrical or cone-shaped sheet metal liner engaging the round head end and a sheet metal transition piece that transitions the hot gas flowpath from the round cross-section of the liner to an arc-shaped sector of the inlet to the turbine. These two pieces are mated with a flexible joint, which requires some portion of compressor discharge air to be consumed in cooling flow and leakage at the joint.

Traditional gas turbine combustors use diffusion (i.e., non-premixed) combustion in which fuel and air enter the combustion chamber separately. The process of mixing and burning produces flame temperatures exceeding 3900° F. Since conventional combustor liners and/or transition pieces having metallic walls are generally capable of withstanding a maximum metal temperature on the order of only about 1500° F. for about ten thousand hours (10,000 hrs.), steps to protect the combustor liner and/or transition piece must be taken.

Because diatomic nitrogen rapidly dissociates at temperatures exceeding about 3000° F. (about 1650° C.), the high temperatures of diffusion combustion result in relatively high NOx emissions. One approach to reducing NOx emissions has been to premix the maximum possible amount of compressor air with fuel. The resulting lean premixed combustion produces cooler flame temperatures and thus lower NOx emissions. The assignee of the present invention has used the term "Dry Low NOx" (DLN) to refer to lean premixed combustion systems with no diluents (e.g., water injection) for further flame temperature reduction. Although lean premixed combustion is cooler than diffusion combustion, the flame temperature is still too hot for uncooled combustor components to withstand.

Furthermore, because the advanced combustors premix the maximum possible amount of air with the fuel for NOx reduction, little or no cooling air is available, making film-cooling of the combustor liner and transition piece impractical. Nevertheless, combustor chamber walls require active cooling to maintain material temperatures below limits. In DLN combustion systems, this cooling can only be supplied as cold side convection. Such cooling must be performed within the requirements of thermal gradients and pressure loss. Thus, means such as thermal barrier coatings in conjunction with "backside" cooling have been considered to protect the combustor liner and transition piece from destruction by such high heat. Backside cooling involves passing the compressor discharge air over the outer surface of the transition piece and combustor liner prior to premixing the air with the fuel.

At temperatures consistent with current-technology DLN combustion, some enhancement of backside convective heat transfer is needed, over and above the heat transfer that can be achieved with simple convective cooling and within acceptable pressure losses. With respect to the combustor liner, one current practice is to impingement cool the liner. Another practice is to provide linear turbulators on the exterior surface of the liner. Another more recent practice is to provide an array of concavities on the exterior or outside surface of the liner (see U.S. Pat. No. 6,098,397). The various known techniques enhance heat transfer but with varying effects on thermal gradients and pressure losses. Turbulation strips work by providing a blunt body in the flow which disrupts the flow creating shear layers and high turbulence to enhance heat transfer on the surface. Dimple concavities function by providing organized vortices that enhance flow mixing and scrub the surface to improve heat transfer.

A low heat transfer rate from the cold side of the liner can lead to high liner surface temperatures and ultimately loss of strength. Several potential failure modes due to the high temperature of the liner include, but are not limited to, cracking, bulging and oxidation. These mechanisms shorten the life of the liner, requiring replacement of the part prematurely.

Additionally, conventional can combustors present a long flow path to the system, resulting in high pressure loss and long residence time of the hot gas. Long residence time is beneficial to CO reduction at low power, low temperature conditions, but is detrimental to NOx formation at high power, high temperature conditions.

Accordingly, there remains a need for a combustor that completes combustion with low emissions and low pressure loss, that presents sufficient residence time to the hot gas to complete the combustion process without excessive CO formation, and that allows for adequate mixing of the burned gases to reduce the temperature non-uniformity entering the turbine, and that preserves the maximum possible amount of compressor discharge air for premixing.

BRIEF DESCRIPTION OF THE INVENTION

The above discussed and other drawbacks and deficiencies are overcome or alleviated in exemplary embodiments by a can combustor that includes a transition piece transitioning directly from a combustor head-end to a turbine inlet using a single piece transition piece for an industrial turbine. In an exemplary embodiment, the transition piece is jointless.

In yet another embodiment, an industrial turbine engine includes a combustion section; an air discharge section downstream of the combustion section; a transition region between the combustion and air discharge section; a combustor transition piece defining the combustion section and transition region, said transition piece adapted to carry hot combustion gases to a first stage of the turbine corresponding to the air discharge section; and a flow sleeve surrounding said combustor transition piece, said flow sleeve having a plurality of rows of cooling apertures for directing cooling air from compressor discharge air into a flow annulus between the flow sleeve and the transition piece.

In an alternative embodiment, a method for cooling a combustor transition piece of a gas turbine combustor, the combustor transition piece having a substantially circular forward cross-section and an arc-shaped aft end, and a flow sleeve surrounding the transition piece in substantially concentric relationship therewith creating a flow annulus therebetween for feeding air to the gas turbine combustor is disclosed. The method includes: using a single-piece transition piece transitioning directly from a combustor head-end to a turbine inlet, and flowing compressor discharge air within said flow annulus in a direction opposite to a normal flow direction of feeding air to the gas turbine combustor The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several Figures.

DETAILED DESCRIPTION OF THE INVENTION

Figure 1:
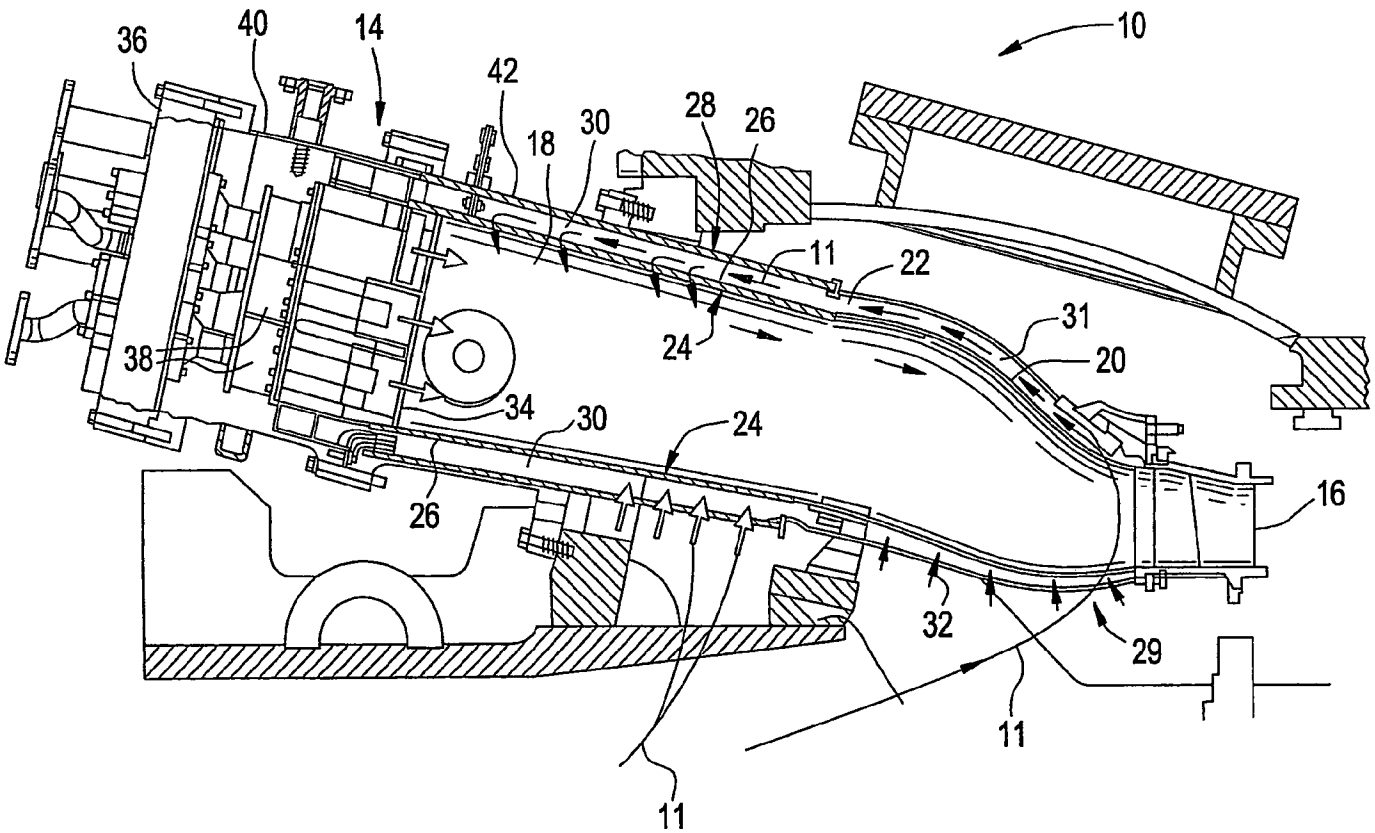
Prior Art FIG. 1
FIG. 1 is a schematic representation of a known gas turbine combustor.

Referring to FIG. 1, a can-annular reverse-flow combustor 10 is illustrated. The combustor 10 generates the gases needed to drive the rotary motion of a turbine by combusting air and fuel within a confined space and discharging the resulting combustion gases through a stationary row of vanes. In operation, discharge air 11 from a compressor (compressed to a pressure on the order of about 250–400 lb/sq-in) reverses direction as it passes over the outside of the combustors (one shown at 14) and again as it enters the combustor en route to the turbine (first stage indicated at 16). Compressed air and fuel are burned in the combustion chamber 18, producing gases with a temperature of about 1500° C. or about 2730° F. These combustion gases flow at a high velocity into turbine section 16 via transition piece 20. The transition piece 20 connects to a combustor liner 24 at connector 22, but in some applications, a discrete connector segment may be located between the transition piece 20 and the combustor liner. As the discharge air 11 flows over the outside surface 26 of the transition piece 20 and combustor liner 24, it provides convective cooling to the combustor components.

In particular, there is an annular flow of the discharge air 11 that is convectively processed over the outside surface 26 (cold side) of liner 24. In an exemplary embodiment, the discharge air flows through a first flow sleeve 29 (e.g., impingement sleeve) and then a second flow sleeve 28, which form an annular gap 30 so that the flow velocities can be sufficiently high to produce high heat transfer coefficients. The first and second flow sleeves 29 and 28, which are located at both the transition piece 20 and the combustor liner 24, respectively, are two separate sleeves connected together. Specifically, the impingement sleeve 29 (or, first flow sleeve) of the transition piece 20 is received in a telescoping relationship in a mounting flange on the aft end of the combustor flow sleeve 28 (or, second flow sleeve), and the transition piece 20 also receives the combustor liner 24 in a telescoping relationship. The impingement sleeve 29 surrounds the transition piece 20 forming a flow annulus 31 (or, first flow annulus) therebetween. Similarly, the combustor flow sleeve 28 surrounds the combustor liner 24 creating a flow annulus 30 (or, second flow annulus) therebetween. It can be seen from the flow arrow 32, that cross flow cooling air traveling in the annulus 31 continues to flow into the annulus 30 in a direction perpendicular to impingement cooling air flowing through cooling holes, slots, or other openings formed about the circumference of the flow sleeve 28 and impingement sleeve 29. The flow sleeve 28 and impingement sleeve 29 have a series of holes, slots, or other openings (not shown) that allow the discharge air 11 to move into the flow sleeve 28 and impingement sleeve 29 at velocities that properly balance the competing requirements of high heat transfer and low pressure drop.

Can combustors are expensive because of their high parts count. The major parts as illustrated in FIG. 1 include a circular cap 34, an end cover 36 supporting a plurality of fuel nozzles 38, the cylindrical liner 24, the cylindrical flow sleeve 28, forward and aft pressure casings 40 and 42, the transition piece 20, and the impingement sleeve 29 controlling flow around the transition piece 20.

Figure 2:
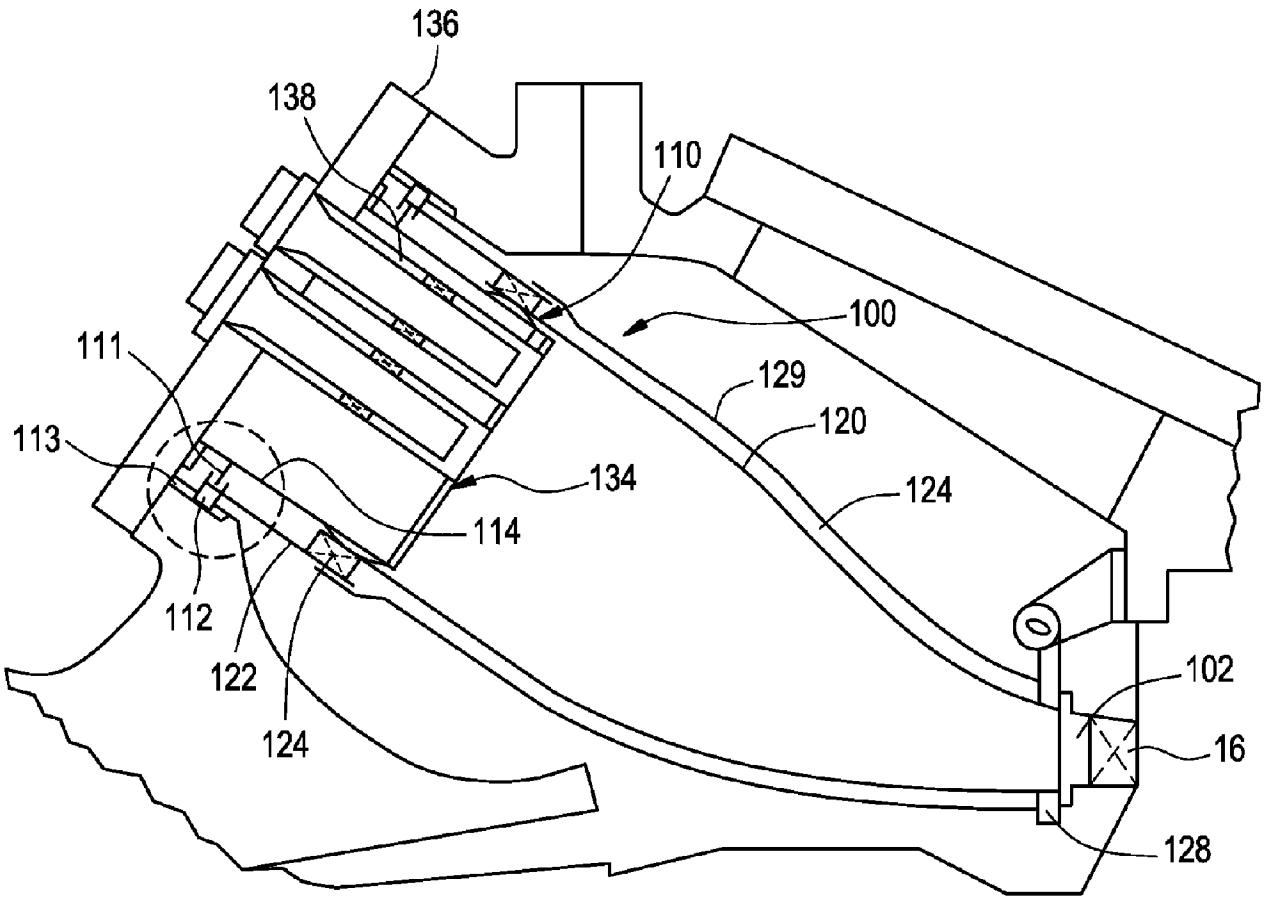
FIG. 2 is a schematic representation of a one-piece combustor liner or extended transition piece surrounded by an impingement sleeve in accordance with an exemplary embodiment.

In an exemplary embodiment referring to FIG. 2, the cylindrical combustor liner 24 of FIG. 1 is eliminated, and a transition piece 120 transitions directly from a circular combustor head-end 100 to a turbine annulus sector 102 (corresponding to the first stage of the turbine indicated at 16) with a single piece. The single piece transition piece 120 may be formed from two halves or several components welded or joined together for ease of assembly or manufacture. Likewise, the first flow sleeve 28 is eliminated, and an impingement sleeve 129 transitions directly from the circular combustor head-end 100 to the aft frame 128 of the transition piece 120 with a single piece. The single piece impingement sleeve 129 may be formed from two halves and welded or joined together for ease of assembly. The joint between the impingement sleeve 129 and the aft frame 128 forms a substantially closed end to the cooling annulus 124. It should be noted that "single" also means multiple pieces joined together wherein the joining is by any appropriate means to join elements, and/or unitary, and/or one-piece, and the like.

The major components include, similar to the prior art: a circular cap 134, an end cover 136 supporting a plurality of fuel nozzles 138, the transition piece 120 and impingement sleeve 129. The transition piece 120 also supports a forward sleeve 122 that may be fixedly attached to the transition piece 120 through radial struts 124, e.g., by welding. Major components eliminated by this exemplary configuration include the forward and aft pressure cases 40 and 42, respectively, the cylindrical combustor liner 24, and the cylindrical flow sleeve 28 surrounding liner 24. Depending upon the configuration, other components not shown in FIG. 1 may be eliminated such as outer crossfire tubes (since the crossfire tubes may be enclosed in the compressor discharge casing) and the transition piece support bracket, or "bullhorn bracket."

At the forward end, the combustor transition piece is supported on a conventional hula seal 110 attached to the cap 134. More specifically, cap 134 is fitted with an associated compression-type seal 110, commonly referred to as a "hula seal", located between transition piece 120 and cap 134. In this configuration, cap 134 is fixedly mounted to end cover 136. While the above described exemplary embodiment is one solution that was worked out for one configuration of a gas turbine manufactured by the assignee of the present application, there are other conceivable configurations that would preserve the intent of a one-piece can combustor. For example, the hula seal could be inverted and attached to the transition piece 120. In another example, the forward sleeve 122 is optionally integral with transition piece 120, by casting, for example, but not limited thereto.

Figure 3:
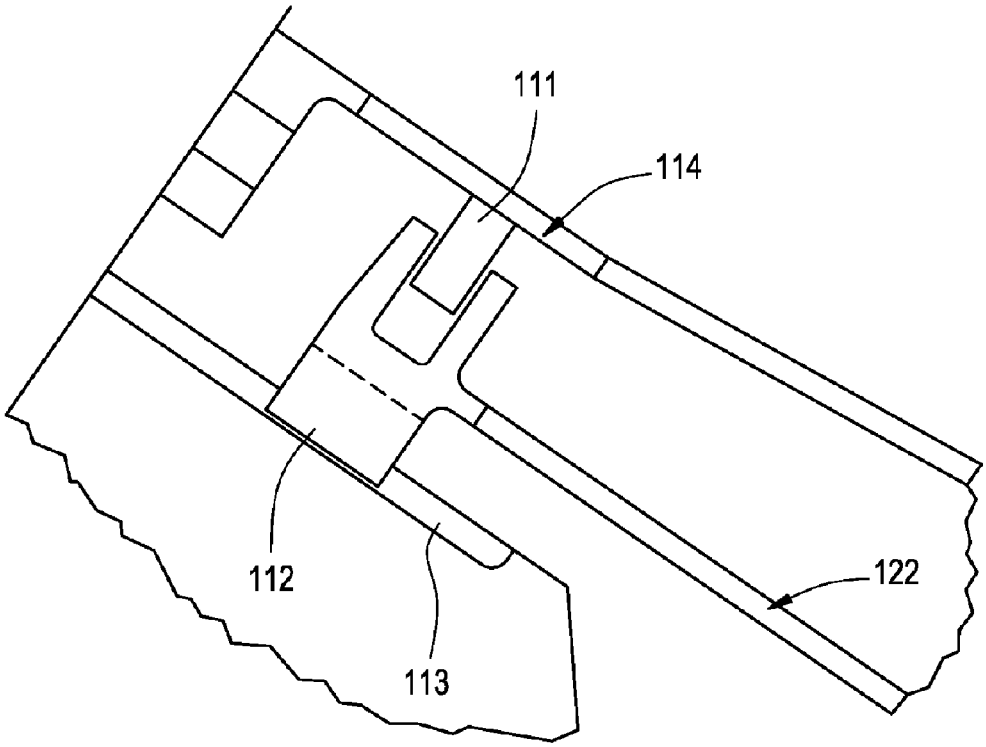
FIG. 3 is detail view of the phantom line circle of FIG. 2 depicting a means of locating and positioning the transition piece and a forward sleeve during assembly.
Figure 4:
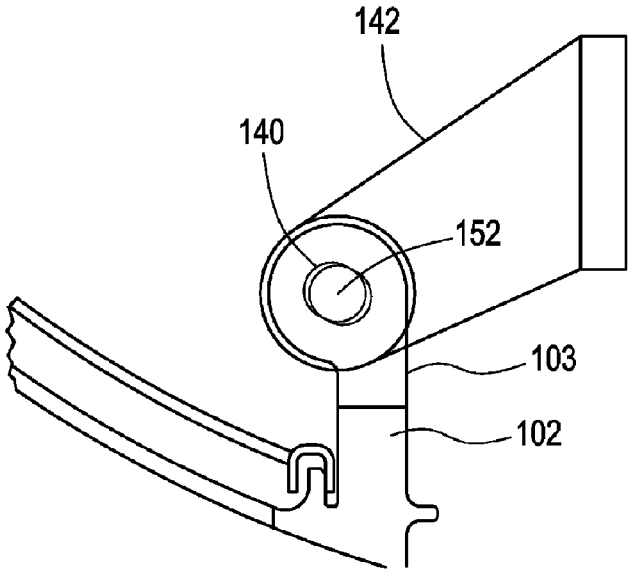
FIG. 4 is a schematic representation of an aft mounting bracket illustrating elongated slots to facilitate installation of the one-piece combustor liner of FIG. 2 in accordance with an exemplary embodiment.

The arrangement described above provides location and support of the transition piece in operation using the hula seal 110 joint with the fixedly-mounted cap assembly 134. During assembly of the combustion hardware, the cap 134 is not in place, and another means of support of the transition piece at its forward end is needed. The means of support is provided in accordance with an exemplary embodiment depicted in the detail view of FIG. 3. Specifically, protrusions or keys 112 are provided on the forward portion of the forward sleeve 122 that engage in keyway slots 113 in the compressor casing, thereby locating and positioning the transition piece and forward sleeve 122 during assembly. Also at the forward end, a piston ring 111 slidingly engages an outer surface 114 of the cap 134 to seal against uncontrolled leakage of compressor discharge air past the impingement sleeve and flow sleeve assemblies. While the features shown in FIG. 3 represent one embodiment of the invention, other configurations are conceivable that would satisfy the need for locating and sealing of the head-end of the one-piece can combustor. For example, the keys 112 and keyway slots 113 could be replaced by pins engaging slots (as depicted in FIG. 4) or holes in the compressor casing, or a conventional bracket with slidably-engaging slots on the transition piece are optionally employed. Similarly, the piston ring seal is optionally replaced by a hula seal.

While this invention is described in relation to a conventional can combustor with a round or circular head-end, it may be feasible or practical in some embodiments to form the head-end in a shape that is other than round or circular, including, for instance, an elliptical shape. Such alternative embodiments fall within the scope of this invention.

In accordance with the disclosure, to be effective at its primary function, i.e., complete combustion with low emissions, the one piece can combustor configuration must present sufficient residence time to the hot gas to complete the combustion process without excessive CO formation, and the flow path must allow for adequate mixing of the burned gases to reduce the temperature non-uniformity entering the turbine. The configuration depicted in FIG. 2 has been shown analytically to be capable of accomplishing these goals without the added length of the liner 24 in FIG. 1. Features enabling a shorter length of transition piece 120 in FIG. 2 compared to transition piece 20 and liner 24 of FIG. 1 include a large-diameter head-end resulting in reduced bulk fluid velocity and increased residence time in the head-end, and flame temperature control using variable-geometry features of the remainder of the turbine. These variable-geometry features are not a part of this invention and are not discussed further here. Further marginal CO improvement is expected by a reduced surface area of liner 24 and transition piece 120, where reaction quenching normally takes place in the boundary layer, as well as reduced quenching associated with leakage and cooling flow in an interface between transition piece 20 and liner 24 with reference to FIG. 1.

It will be recognized by one skilled in the pertinent art that the mechanical assembly of the combustor is challenged with a single-piece construction, because there are fewer degrees of freedom of motion to accommodate dimensional stack up tolerances. More specifically, the circumferential positioning of the head-end of the transition piece must allow for stack up errors such that the support means at the head-end are not excessively statically loaded due to misalignments. In an exemplary embodiment referring to FIG. 4, the allowance for circumferential assembly tolerances is made by a slight elongation of slots generally indicated at 140 in a mounting bracket 142 at the aft end, permitting slight side-to-side motion at the head-end 100. This feature is illustrated schematically in FIG. 4. More specifically, elongated slots 140 on either side of mounting bracket 142 allow fore-to-aft movement thereof when mounting the aft support lug 103 having or receiving mounting pins 152. The fore-to-aft movement of aft end 102 of transition piece 120 is limited by translation of pins 152 in a respective slot 140. Hence, side-to-side motion of the head end 100 of the transition piece is effected by moving one side of pin 152 forward in the bracket 142, and the other side of pin 152 aft in the bracket 142. Pin 152 may also be implemented as a bolt or bolts.

Advantages of exemplary embodiments of a one piece can combustor include application to existing turbine designs, low cost, improved performance, ease of assembly, and high reliability. Exemplary embodiments of the invention address the high cost of conventional can combustors by eliminating several major components. Exemplary embodiments of the invention also provide for better performance and emissions by reducing pressure losses and by reducing the exposure of the hot gas to relatively cold metal walls. A further advantage includes reduction of airflow used for cooling and leakage, since the joint between the transition piece and liner is eliminated. The reduced surface area decreases the heat pickup of the combustion air before it enters the flame zone, and reduces the CO quenching in the boundary layer. It is further envisioned that reliability is improved primarily as a result of the reduced parts count and the reduced number of rubbing interfaces. The one-piece can combustor configuration disclosed herein may be employed in the context of a standard or diffusion-type combustor without departing from the scope of the invention.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A can combustor for an industrial turbine comprising:

a transition piece transitioning directly from a combustor head-end to a turbine inlet using a single piece transition piece; and a means for supporting the transition piece with a forward sleeve during assembly before a cap is assembled thereto, wherein the means for supporting includes one of protrusions and keys on a forward portion of the forward sleeve that engage holes and keyway slots, respectively, disposed at a compressor casing.

2. The can combustor of claim 1, wherein the transition piece is jointless.

3. The can combustor of claim 1, further comprising:

an impingement sleeve surrounding the transition piece, the impingement sleeve having a plurality of cooling apertures formed about a circumference thereof receptive to directing cooling air from compressor discharge air into a flow annulus between the impingement sleeve and the transition piece.

4. The can combustor of claim 3, wherein the impingement sleeve transitions directly from a combustor forward sleeve to an aft frame of a transition piece using a single piece sleeve.

5. The can combustor of claim 1, further comprising:

a mounting bracket disposed at an aft end of the transition piece, the bracket having elongated slots receptive to mounting pins extending therethrough permitting side-to-side motion at a head end of the transition piece.

6. The can combustor of claim 1, wherein the bracket includes a pair of the elongated slots disposed at opposing sides of the bracket.

7. The can combustor of claim 1, further comprising:

a hula seal attached to an outer surface of a cap.

8. The can combustor of claim 7, wherein said hula seal is receptive to engaging the head end of the transition piece.

9. The can combustor of claim 7, wherein the cap is fixedly mounted to an end cover at the head end of the combustor.

10. The can combustor of claim 7, further comprising:

a forward sleeve fixedly attached to the transition piece and locating the transition piece during assembly to the turbine using key protrusions and keyway slots in the turbine frame.

11. The can combustor of claim 10, further comprising:

a piston ring seal between the forward sleeve and cap.

12. An industrial turbine engine comprising:

a combustion section;

an air discharge section downstream of the combustion section;

a transition region between the combustion and air discharge section;

a combustor transition piece defining the combustion section and transition region, said transition piece adapted to carry hot combustion gases to a first stage of the turbine corresponding to the air discharge section;

a flow sleeve surrounding said combustor transition piece, said flow sleeve having a plurality of rows of cooling apertures for directing cooling air from compressor discharge air into a flow annulus between the flow sleeve and the transition piece; and a means for supporting the transition piece with a forward sleeve during assembly before a cap is assembled thereto, wherein the means for supporting includes one of protrusions and keys on a forward portion of the forward sleeve that engage holes and keyway slots, respectively, disposed at a compressor casing.

13. The turbine of claim 12, wherein at least one said transition piece transitions directly from a combustor head-end to a turbine inlet using a single piece and the flow sleeve transitions directly from a combustor head-end to the aft frame of the transition piece using a single piece sleeve.

14. The turbine of claim 12, further comprising:

a mounting bracket disposed at an aft end of the transition piece, the bracket having elongated slots receptive to mounting pins extending therethrough permitting side-to-side motion at a head end of the transition piece.

15. The turbine of claim 14, wherein the bracket includes a pair of the elongated slots disposed at opposing sides of the bracket.

16. The turbine of claim 12, further comprising:

a hula seal attached to an outer surface of a cap.

17. The turbine of claim 16, wherein said hula seal is receptive to engaging the head end of the transition piece.

18. The turbine of claim 12, further comprising:

a seal intermediate the cap and forward sleeve, the seal sealing against leakage of compressor discharge air past the flow sleeve and forward sleeve.

19. The turbine of claim 12, wherein the forward sleeve is integral with the transition piece.

* * * * *